US008573258B2

(12) United States Patent
Lin

(10) Patent No.: US 8,573,258 B2
(45) **Date of Patent: *Nov. 5, 2013**

(54) FAUCET

(76) Inventor: Chen-Chang Lin, Shengang Township (TW)

( * ) Notice: Subject to any disclaimer, the term of this patent is extended or adjusted under 35 U.S.C. 154(b) by 504 days.

This patent is subject to a terminal disclaimer.

(21) Appl. No.: 12/900,238

(22) Filed: Oct. 7, 2010

(65) Prior Publication Data

US 2012/0085446 A1 Apr. 12, 2012

(51) Int. Cl.

| | |
|---|---|
| ***F16K 21/00*** | (2006.01) |
| ***E03B 1/00*** | (2006.01) |
| ***E03C 1/086*** | (2006.01) |
| ***B05B 1/00*** | (2006.01) |
| ***B05B 1/04*** | (2006.01) |

(52) U.S. Cl.
USPC ..... 137/801; 137/599.03; 137/603; D23/255; 239/589; 239/592

(58) Field of Classification Search
USPC ..... 137/801, 601.18, 599.03, 603; 4/675, 4/676, 677, 678; D23/238–240, 255; 239/17, 24, 25, 589, 590.5, 504, 592
See application file for complete search history.

(56) References Cited

U.S. PATENT DOCUMENTS

| | | | | |
|---|---|---|---|---|
| 4,889,165 | A * | 12/1989 | Newcombe et al. | 137/801 |
| 8,251,094 | B2 * | 8/2012 | Lin | 137/601.18 |
| 8,316,887 | B2 * | 11/2012 | Lin | 137/601.18 |
| 2011/0272050 | A1 * | 11/2011 | Lin | 137/801 |
| 2011/0289676 | A1 * | 12/2011 | Lin | 4/675 |

* cited by examiner

*Primary Examiner* — Craig Schneider
*Assistant Examiner* — Michael R Reid
(74) *Attorney, Agent, or Firm* — Hershkovitz & Associates, PLLC; Abraham Hershkovitz

(57) ABSTRACT

A faucet has a hollow main body. The main body has a mounting section, an extending section, at least one inlet and a passage. The mounting section has a top and a bottom. The extending section is mounted securely on the top of the mounting section and has an extending direction and at least one elongated outlet. The at least one elongated outlet is formed in the extending section and has a maximal length along the extending direction of the extending section. The at least one inlet is formed in the bottom of the mounting section. The passage is formed in the main body and communicates with the at least one elongated outlet and the at least one inlet. Because the elongated outlets are elongated along the extending direction of the extending section, an efflux from the elongated outlet can conform to hands of users and enhance washing efficiency.

1 Claim, 5 Drawing Sheets

FAUCET

BACKGROUND OF THE INVENTION

1. Field of the Invention

The present invention relates to a faucet, and more particularly to a faucet having at least one elongated outlet to make an efflux conforming to and efficiently washing hands of users.

2. Description of Related Art

A conventional faucet is mounted securely on a sink or a basin and has a main body. The main body has a mounting section, an extending section, an inlet, an outlet and a passage. The mounting section is mounted securely on the sink or the basin. The extending section is mounted securely on a top of the mounting section and has an extending direction usually parallel to that of hands of users extending toward the faucet while using the faucet. The inlet is formed in a bottom of the main body. The outlet is formed in the extending section. The passage is formed in the main body and communicates with the inlet and the outlet to allow water to flow out from the outlet to wash the hands of users.

However, the outlet is usually elongated along a line perpendicular to the extending direction of the extending section, such that an efflux from the outlet cannot approximately conform to and efficiently wash the hands of users. Moreover, the efflux concentrates on part of the hands and creates water splashes.

To overcome the shortcomings, the present invention tends to provide a faucet to mitigate the aforementioned problems.

SUMMARY OF THE INVENTION

The main objective of the invention is to provide a faucet having at least one elongated outlet to make an efflux conforming to and efficiently washing hands of users.

A faucet has a hollow main body. The main body has a mounting section, an extending section, at least one inlet and a passage. The mounting section has a top and a bottom. The extending section is mounted securely on the top of the mounting section and has an extending direction and at least one elongated outlet. The at least one elongated outlet is formed in the extending section and has a maximal length along the extending direction of the extending section. The at least one inlet is formed in the bottom of the mounting section. The passage is formed in the main body and communicates with the at least one elongated outlet and the at least one inlet. Because the elongated outlets are elongated along the extending direction of the extending section, an efflux from the elongated outlet can conform to hands of users and enhance washing efficiency.

Other objects, advantages and novel features of the invention will become more apparent from the following detailed description when taken in conjunction with the accompanying drawings.

DETAILED DESCRIPTION OF PREFERRED EMBODIMENT

Figure 1:
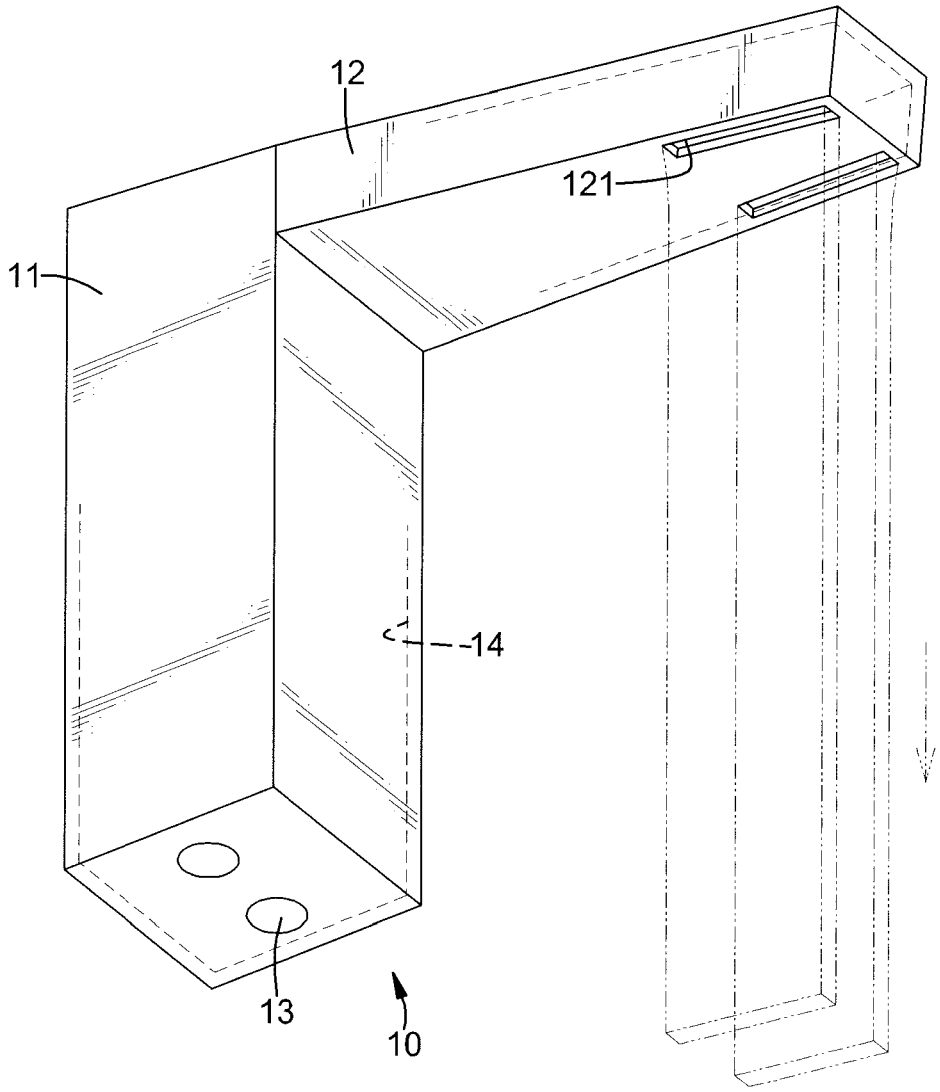
FIG. 1 is a perspective view of a first embodiment of a faucet in accordance with the present invention.
Figure 2:
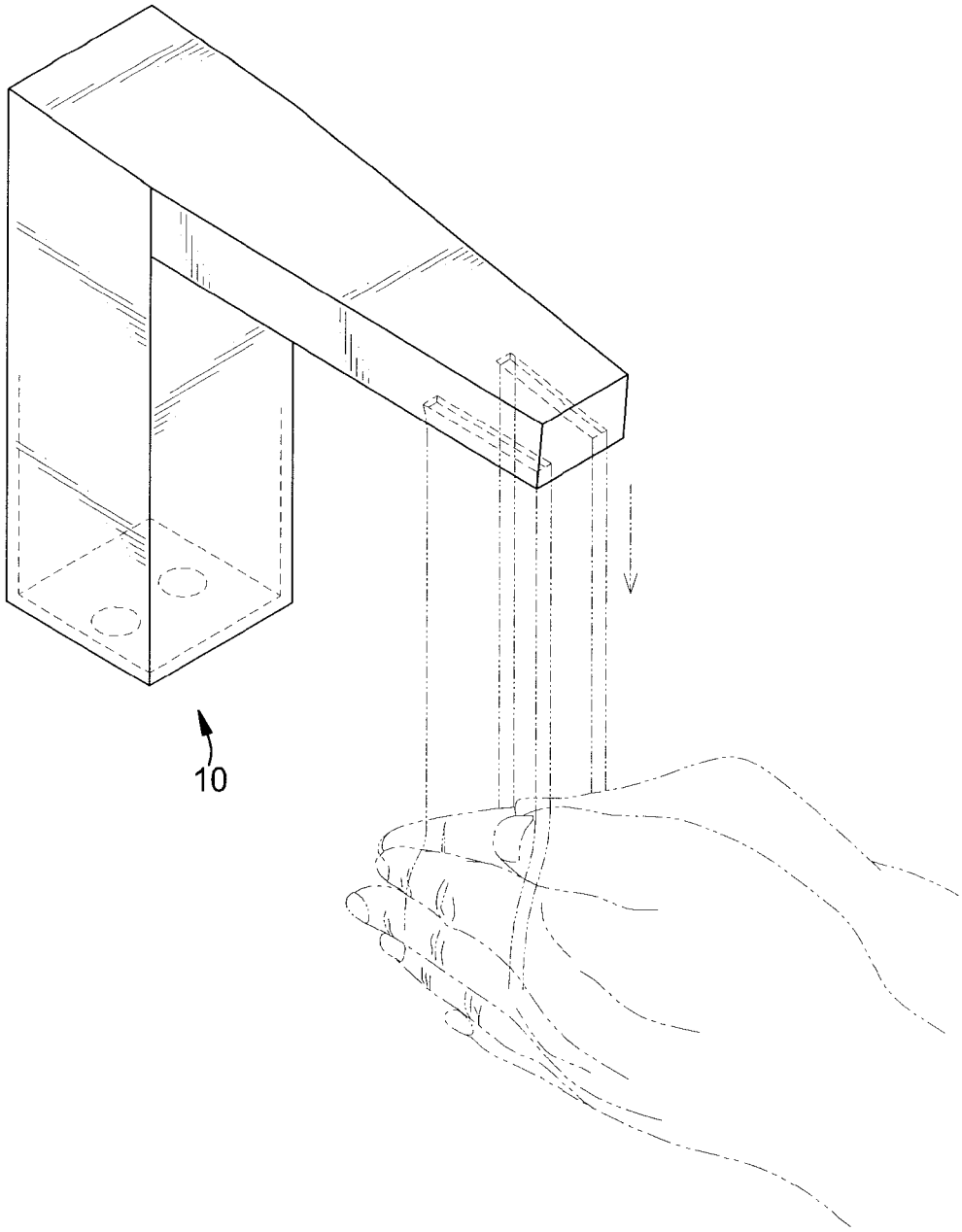
FIG. 2 is an operational perspective view of the first embodiment of the faucet in FIG. 1.

With reference to FIGS. 1 to 2, a first embodiment of a faucet in accordance with the present invention comprises a hollow main body 10.

The main body 10 has a mounting section 11, an extending section 12, at least one inlet 13 and a passage 14. The mounting section 11 has a top and a bottom. The bottom of the mounting section 11 is opposite to the top of the mounting section 11. The extending section 12 is mounted securely on the top of the mounting section 11 and has an extending direction and at least one elongated outlet 121. The at least one elongated outlet 121 is formed in the extending section 12 and has a maximal length along the extending direction of the extending section 12. The at least one inlet 13 is formed in the bottom of the mounting section 11. The passage 14 is formed in the main body 10 and communicates with the at least one elongated outlet 121 and the at least one inlet 13.

In a first embodiment of the faucet in accordance with the present invention, the extending section 12 is a pole and has a first end and a second end. The first end of the extending section 12 is connected to the mounting section 11. The second end of the extending section 12 is opposite to the first end of the extending section 12 and has a bottom surface.

Two elongated outlets 121 are implemented and linear, and each elongated outlet 121 has two opposite long sides, two opposite short sides and an opening. The long sides of each elongated outlet 121 are along the extending direction of the extending section 12. Each short side of the elongated outlet 121 is connected with the long sides of the elongated outlet 121. The opening of each elongated outlet 121 is located at a horizontal plane.

When in use, the mounting section 11 is mounted securely on a sink or a basin and is connected with a water source. Water in sequence flows from the inlets 13, the passage 14 and the elongated outlets 121 to form an efflux shaped like two parallel screens. Because the elongated outlets 121 are elongated along the extending direction of the extending section 12, the efflux can conform to and efficiently wash hands of users.

Figure 3:
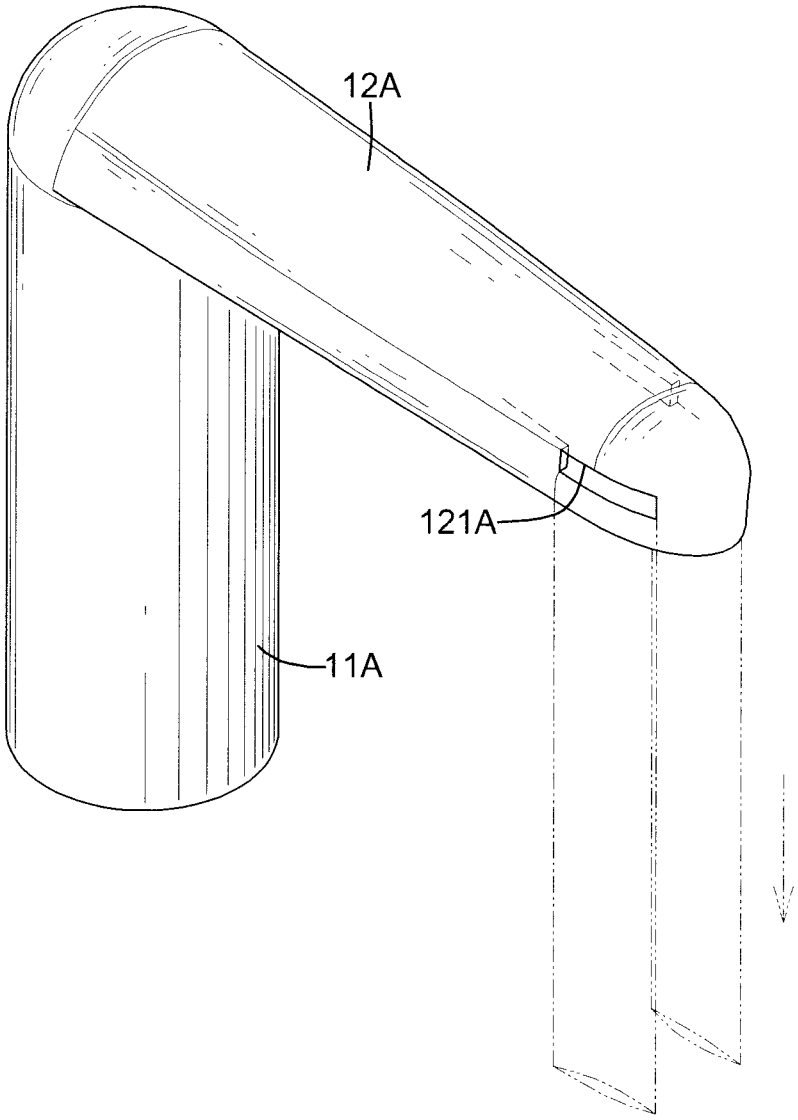
FIG. 3 is a perspective view of a second embodiment of the faucet in accordance with the present invention.

With reference to FIG. 3, in a second embodiment of the faucet in accordance with the present invention, the extending section 12A is a pole and has a first end and a second end. The first end of the extending section 12A is connected to the mounting section 11A. The second end of the extending section 12A is opposite to the first end of the extending section 12A and has two opposite side surfaces.

Two elongated outlets 121A are implemented and linear, are respectively formed though the side surfaces of the second end of the extending section 12A, and each elongated outlet 121A has two opposite long sides and two opposite short sides. The long sides of each elongated outlet 121A are along the extending direction of the extending section 12A. Each short side of the elongated outlet 121A is connected with the long sides of the elongated outlet 121A and is perpendicular to a horizontal plane.

Figure 4:
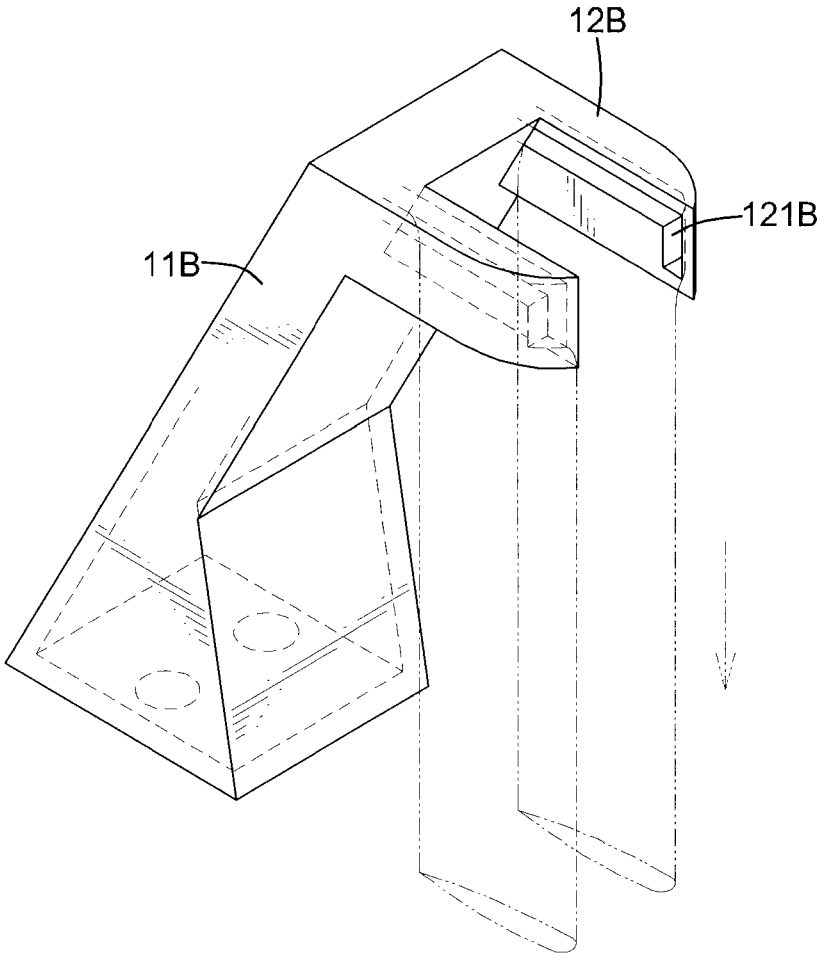
FIG. 4 is a perspective view of a third embodiment of the faucet in accordance with the present invention.

With reference to FIG. 4, in a third embodiment of the faucet in accordance with the present invention, the extending section 12B is U-shaped and has a central segment and two arms. The central segment of the extending section 12B is connected to the mounting section 11B. The arms of the extending section 12B are respectively connected securely on the central segment of the extending section 12B and extend along the extending direction of the extending section 12B. Each arm of the extending section 12B has a distal end and an inner surface. The distal ends of the arms are located at a horizontal plane. The inner surfaces of the arms face each other.

Two elongated outlets 121B are implemented, are L-shaped, are respectively formed in the inner surfaces of the arms and extend along the extending direction of the extending section 12B.

Figure 5:
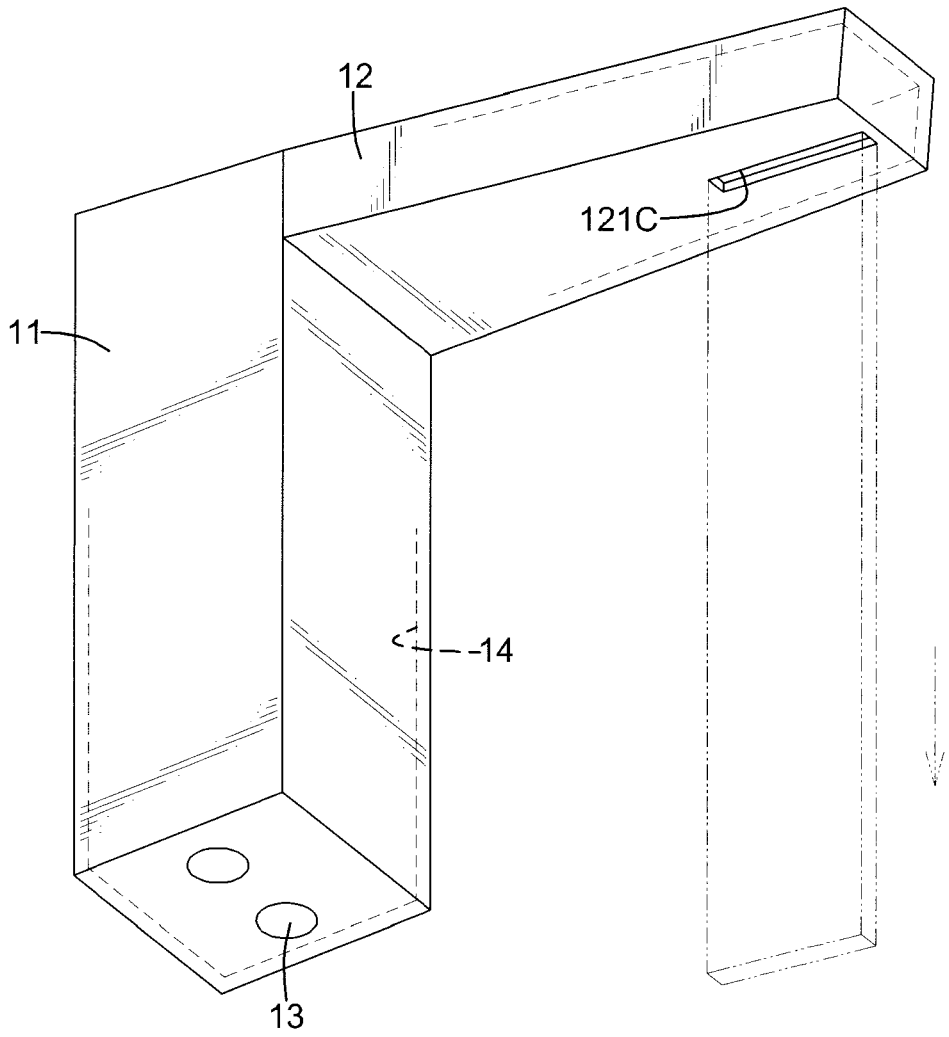
FIG. 5 is a perspective view of a forth embodiment of the faucet in accordance with the present invention.

With reference to FIG. 5, a forth embodiment of the faucet in accordance with the present invention is substantially the same as the first embodiment. A single one elongated outlet 121C is implemented.

From the above description, it is noted that the present invention has the following advantages:

1. Excellent washing efficiency:

Because the elongated outlets 121,121A,121B,121C are elongated along the extending direction of the extending section 12,12A,12B, the efflux can conform to hands of users and enhance washing efficiency.

2. Reducing water splashes:

Because the efflux evenly flushes hands of users and does not concentrate on part of the hands, water splashes can be reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A faucet comprising:

a hollow main body having a mounting section having a top; and a bottom opposite to the top of the mounting section;

a U-shaped extending section mounted securely on the top of the mounting section and having an extending direction; and at least two L-shaped elongated outlets formed in the extending section and having a maximal length along the extending direction of the extending section;

a central segment connected to the mounting section; and two arms respectively connected securely on the central segment of the extending section and extending along the extending direction of the extending section, each arm having a distal end, wherein the distal ends of the arms are located at a horizontal plane; and an inner surface, wherein the inner surfaces of the arms face each other, and the outlets are respectively formed in the inner surfaces of the arms and the outlets are extending along the extending direction of the extending section;

at least one inlet formed in the bottom of the mounting section; and a passage formed in the main body and communicating with the at least one elongated outlets and the at least one inlet.

* * * * *